US012092126B2

(12) United States Patent
Milner et al.

(10) Patent No.: US 12,092,126 B2
(45) Date of Patent: Sep. 17, 2024

(54) OIL FEED ASSEMBLY FOR A VACUUM PUMP HAVING A VENTING CONDUIT

(71) Applicant: Edwards Limited, Burgess Hill (GB)

(72) Inventors: Paul Milner, Burgess Hill (GB); Nicolas Jonathan Grant, Burgess Hill (GB); Emiliano Lucchetta, Burgess Hill (GB)

(73) Assignee: Edwards Limited, Burgess Hill (GB)

( * ) Notice: Subject to any disclaimer, the term of this patent is extended or adjusted under 35 U.S.C. 154(b) by 680 days.

(21) Appl. No.: 17/288,289

(22) PCT Filed: Oct. 23, 2019

(86) PCT No.: PCT/GB2019/053015
§ 371 (c)(1),
(2) Date: Apr. 23, 2021

(87) PCT Pub. No.: WO2020/084302
PCT Pub. Date: Apr. 30, 2020

(65) Prior Publication Data

US 2021/0372421 A1 Dec. 2, 2021

(30) Foreign Application Priority Data

Oct. 25, 2018 (GB) ..... 1817356

(51) Int. Cl.
*F04D 29/063* (2006.01)
*F04D 19/04* (2006.01)
*F04D 29/059* (2006.01)

(52) U.S. Cl.
CPC ..... *F04D 29/063* (2013.01); *F04D 19/042* (2013.01); *F04D 29/059* (2013.01)

(58) Field of Classification Search
CPC .... F04D 19/042; F04D 29/059; F04D 29/063; F16C 33/6637; F16C 33/6685; F16C 33/6666; F16C 2360/42–45
(Continued)

(56) References Cited

U.S. PATENT DOCUMENTS 3,168,977 A 7/1962 Garnier et al.
3,168,978 A * 2/1965 Henri ..... F04D 25/0653 416/198 R (Continued)

FOREIGN PATENT DOCUMENTS

DE 60216187 T2 10/2007
GB 2553766 A1 3/2018

(Continued)

OTHER PUBLICATIONS

British Search Report dated Apr. 5, 2019 and Examination Report dated Apr. 8, 2019 for corresponding British Application No. GB1817356.7, 5 pages.

(Continued)

*Primary Examiner* — Charles G Freay
*Assistant Examiner* — Benjamin Doyle
(74) *Attorney, Agent, or Firm* — Theodore M. Magee; Westman, Champlin & Koehler, P.A.

(57) ABSTRACT

An oil feed assembly for a vacuum pump comprises: an oil feeder located for feeding oil to one side of a bearing of the vacuum pump; an oil sump located on the one side of the bearing and configured to receive excess oil from the oil feeder; and a venting bypass conduit fluidly coupled with the oil sump and with another side of the bearing, the venting bypass conduit having an inlet located at an elevated position above a floor of the oil sump and configured to convey gas from the oil sump to the another side of the bearing. In this way, the venting bypass conduit provides an alternative (Continued)

path which allows gas within the oil sump to escape during pump-down while preventing oil within the oil sump from escaping with the gas travelling through the venting bypass conduit.

12 Claims, 6 Drawing Sheets

(58) Field of Classification Search
USPC ..... 415/110
See application file for complete search history.

(56) References Cited

U.S. PATENT DOCUMENTS 3,628,894 A * 12/1971 Ferguson, Jr. ..... F04D 19/04 417/353
3,812,654 A * 5/1974 Brown ..... B01D 47/021 415/110
4,116,592 A * 9/1978 Cherny ..... F04D 29/584 417/423.4
4,181,379 A 1/1980 Letts
4,674,952 A * 6/1987 Osterstrom ..... F16C 27/00 384/114
4,806,075 A * 2/1989 Osterstrom ..... F16C 27/00 415/230
5,190,438 A * 3/1993 Taniyama ..... F04C 29/025 415/178
6,863,493 B2 * 3/2005 Stones ..... F16N 7/366 415/121.2
7,959,423 B2 * 6/2011 Eilers ..... F04D 29/059 418/94
2004/0036049 A1 2/2004 Symonds, Jr.
2006/0088238 A1 * 4/2006 Englander ..... F04D 29/059 384/625
2016/0097398 A1 * 4/2016 Waye ..... F04D 29/058 415/110
2019/0032662 A1 * 1/2019 Hong ..... F04C 25/02

FOREIGN PATENT DOCUMENTS

JP S62114197 U 7/1987
JP S62168992 A 7/1987
JP H07233792 A 9/1995
JP 2017078351 A 4/2014
JP 2015206340 * 10/2015
WO 2014174273 A1 10/2014

OTHER PUBLICATIONS

PCT Notification of Transmittal of the International Search Report and the Written Opinion of the International Searching Authority, or the Declaration dated Jan. 17, 2020, PCT Search Report and Written Opinion dated Jan. 17, 2020 for corresponding PCT Application No. PCT/GB2019/053015.
Japanese Notification of Reason for Rejected dated Oct. 2, 2023 for corresponding Japanese application Serial No. JP2021521762, 5 pages.

* cited by examiner

OIL FEED ASSEMBLY FOR A VACUUM PUMP HAVING A VENTING CONDUIT

CROSS-REFERENCE OF RELATED APPLICATION

This application is a Section 371 National Stage Application of International Application No. PCT/GB2019/053015, filed Oct. 23, 2019, and published as WO 2020/084302 A1 on Apr. 30, 2020, the content of which is hereby incorporated by reference in its entirety and which claims priority of British Application No. 1817356.7, filed Oct. 25, 2018.

FIELD

The field of the invention relates to an oil feed for a vacuum pump.

BACKGROUND

Vacuum pumps, such as turbomolecular pumps, comprise a rotor comprising a plurality of discs mounted on a rotor shaft for rotation relative to a plurality of stator discs disposed in interleaving relationship with the rotor discs. The rotor shaft is supported by a bearing arrangement that may comprise two bearings located at or intermediate respective ends of the shaft. The upper bearing may be in the form of a magnetic bearing and the lower bearing is typically a rolling bearing.

A typical rolling bearing comprises an inner race fixed relative to the rotor shaft, an outer race and a plurality of rolling elements located between the races for allowing relative rotation of the inner race and the outer race. To prevent mutual contact between the rolling elements they are often guided and evenly spaced by a cage. Adequate lubrication is important to ensure accurate and reliable operation of rolling bearings. The main purpose of the lubricant is to establish a load-carrying film to separate the bearing components in rolling and sliding contact in order to minimise friction and wear. Other purposes include the prevention of oxidation or corrosion of the bearing components, the formation of a barrier to contaminants and the transfer of heat away from the bearing components. The lubricant is generally in the form of either oil or grease (a mixture of oil and a thickening agent).

Vacuum pumps using oil-lubricated bearings require an oil feed system to feed oil between the contact areas of the bearing. This enables the oil to perform cooling as well as lubrication and thereby permits the bearings to run at a faster speed. Turbomolecular vacuum pumps have traditionally used a wicking system for supplying oil to a rolling beating. In such a system, one or more felt wicks are supplied by an oil reservoir and feed oil via one or more stacked felts in a felt stack to a conical "oil feed" nut mounted on the shaft. The felt wicks may lay against respective major surfaces of the staked felts in the felt stack so that the felt wick is sandwiched between stacked felts in the felt stack. This enables oil to wick from the reservoir, via the felt wicks, to the stacked felts and feed that oil to the nut mounted on the shaft. When the shaft rotates, oil travels along the conical surface of the nut to the bearing. The oil then passes through the bearing and is returned to the reservoir under the influence of gravity to be recirculated.

It is desired to provide an improved oil feel system.

The discussion above is merely provided for general background information and is not intended to be used as an aid in determining the scope of the claimed subject matter. The claimed subject matter is not limited to implementations that solve any or all disadvantages noted in the background.

SUMMARY

According to a first aspect, there is provided an oil feed assembly for a vacuum pump, comprising: an oil feeder located for feeding oil to one side of a bearing of the vacuum pump; an oil sump located on the one side of the bearing and configured to receive excess oil from the oil feeder; and a venting bypass conduit fluidly coupled with the oil sump and with another side of the bearing, the venting bypass conduit having an inlet located at an elevated position above a floor of the oil sump and configured to convey gas from the oil sump to the another side of the bearing.

The first aspect recognises that a problem with existing oil feed assemblies is that when the vacuum pump pumps down, gas trapped within the oil feed system can cause oil to be lost. This loss occurs because the gas flowing out of the oil feed system can remove oil with it, which prevents the oil from being captured for recirculation. In time, this leads to insufficient oil being present in the oil feed system, which dries out and results in damage to the pump bearings.

Accordingly, an oil feed assembly is provided. The oil feed assembly may be for a vacuum pump. The oil feed assembly may comprise an oil feeder which is located or configured to feed oil to a first side of a bearing of the vacuum pump. The oil feed assembly may comprise an oil sump, chamber or pot. The oil sump may be located or positioned on the first side of the bearing. The oil sump may be configured or arranged to receive or hold excess or unretained oil which escapes from the oil feeder. The oil feed assembly may comprise a venting bypass conduit which may be in fluid communication with the oil sump. The venting bypass conduit may also be in fluid communication with a second side of the bearing. The venting bypass conduit may have an inlet which is located or arranged at an elevated, raised or offset position from a floor, wall or face of the oil sump. The venting bypass conduit may be configured or arranged to convey or communicate gas from the oil sump to the second side of the bearing. In this way, the venting bypass conduit provides an alternative path which allows gas within the oil sump to escape during pump-down. The location of the inlet to that venting bypass conduit helps to prevent oil within the oil sump from escaping with the gas travelling through the venting bypass conduit. This helps to prevent loss of oil from the oil feeder and prolongs the life of the bearings.

In one embodiment, the elevated position is higher than an expected depth of the excess oil. Accordingly, the inlet may be positioned at a height or location which is above the expected height of any excess oil within the oil sump. This helps to ensure that any oil is prevented from being drawn into the venting bypass conduit.

In one embodiment, the inlet is elevated in an axial direction with respect an axis of the bearing. Accordingly, the inlet may be positioned further along the axial direction of the bearing than the floor of the oil sump.

In one embodiment, the inlet is orientated in the axial direction with respect an axis of the bearing.

In one embodiment, the inlet is elevated in a radial direction with respect an axis of the bearing.

In one embodiment, the inlet is orientated in the radial direction.

In one embodiment, the inlet is located at the elevated position above each floor of the oil sump. Accordingly, the inlet may be positioned above every floor, wall or face of the oil sump. This helps to ensure that oil is prevented from escaping the oil sump irrespective of the orientation of the oil feed assembly.

In one embodiment, the inlet comprises drip edges configured to direct oil away from the inlet. Providing drip edges helps to prevent any oil in the vicinity of the inlet escaping through the venting bypass conduit.

In one embodiment, the venting bypass conduit has a sump section defining the inlet, the sump section extending from at least one floor of the oil sump. Accordingly, the venting bypass conduit may have a first portion which provides the inlet and which extends from a floor of the oil sump.

In one embodiment, the sump section extends further than the expected depth of the excess oil. Accordingly, the sump section may have height and/or length which is greater than the expected depth of the excess oil.

In one embodiment, wherein the sump section extends in an axial direction with respect to an axis of the bearing.

In one embodiment, the sump section extends in a radial direction with respect to an axis of the bearing.

In one embodiment, the sump section is rounded to resist gathering of oil. Accordingly, the sump section may be shaped to prevent oil from gathering.

In one embodiment, the venting bypass conduit comprises a gallery section fluidly coupled with the sump section, extending around the oil feed cap. Accordingly, the sump section may be connected with the gallery section which surrounds the oil sump.

In one embodiment, the gallery section comprises an annulus extending circumferentially, concentric with the bearing. Accordingly, the gallery section may be ring-shaped and surround the oil sump.

In one embodiment, the oil feed assembly may comprise a plurality of sump sections, each defining one the inlet, each sump section being fluidly coupled with the gallery section. Accordingly, more than one sump section may be provided feed a common gallery section. This increases the volume of the venting bypass conduit within the oil sump and reduces the flow rate of gas from the oil sump through the inlets during pump-down.

In one embodiment, the venting bypass conduit comprises a coupling section fluidly coupled with the gallery section.

In one embodiment, the coupling section fluidly couples with the other side of the bearing.

In one embodiment, the coupling section extends axially with respect to an axis of the bearing.

In one embodiment, the coupling section is circumferentially offset from the sump section.

In one embodiment, the sump section and one part of the gallery section are formed as a first unitary part, and the coupling section and another part of the gallery section are formed as a second unitary part. Accordingly, the gallery section may be formed from at least two parts which couple together to form the gallery section. This simplifies manufacture of the gallery section.

In one embodiment, the oil sump defines at least one recess to facilitate flow of gas past the oil feeder. Providing recesses helps to facilitate the flow of gas out of the sump section.

According to a second aspect, there is provided a vacuum pump comprising a bearing and the oil feed assembly of the first aspect.

Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

BRIEF DESCRIPTION OF THE DRAWINGS

Embodiments of the present invention will now be described further, with reference to the accompanying drawings, in which.

DETAILED DESCRIPTION

Overview

Before discussing the embodiments in any more detail, first an overview will be provided. Embodiments provide an oil feed assembly used to feed and recirculate oil to a bearing of a rotating machine such as a vacuum pump. Typically, the assembly is provided within a cap which is fitted to the vacuum pump. The cap has a number of wicks which extend in to a reservoir holding oil used to lubricate the bearing of the vacuum pump. As mentioned above, the oil flows up the wicks and into a series of stacked felts. The stacked felts provide oil to the bearing. When the cap is attached to the vacuum pump, a void, chamber or oil sump holding the felts is sealed by the vacuum pump. When the vacuum pump pumps down, the gas within the void is evacuated by the vacuum pump. Conventionally, such evacuation would occur through the bearing being lubricated by the oil feeder system. However, embodiments provide a bypass conduit which fluidly couples the void with the vacuum pump. This provides an alternative path for gas within the void to be evacuated. The bypass conduit is provided with an inlet within the void which is located so as to help prevent any oil within the void from being removed with the gas during pump-down. In particular, the inlet is located at a position above any face, wall or floor of the void sump on which oil may gather. It will be appreciated that the oil may gather on different faces, depending on the orientation of the vacuum pump. This helps to prevent loss of the oil, which prolongs the life of the hearing and the vacuum pump.

Oil Feed Cap—1st Arrangement

Figure 1:
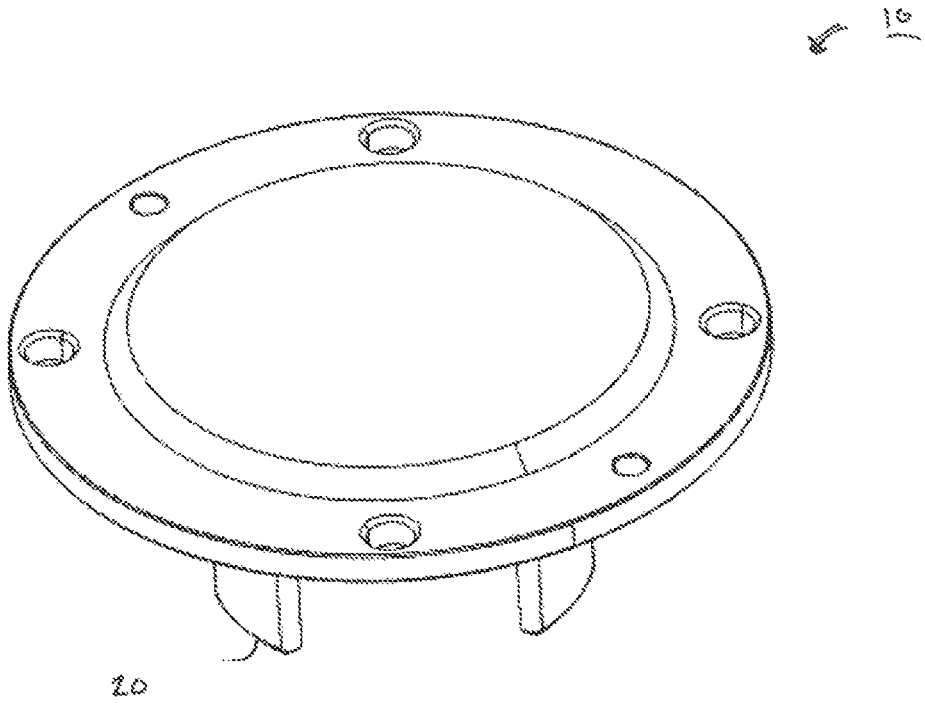
FIG. 1 shows an oil feed cap according to one embodiment.

FIG. 1 shows an oil feed cap 10 which feeds oil to a bearing of a vacuum pump (not shown). The oil feed cap 10 has a number of wick holders 20 which extend into an oil feed reservoir within the vacuum pump.

Figure 2:
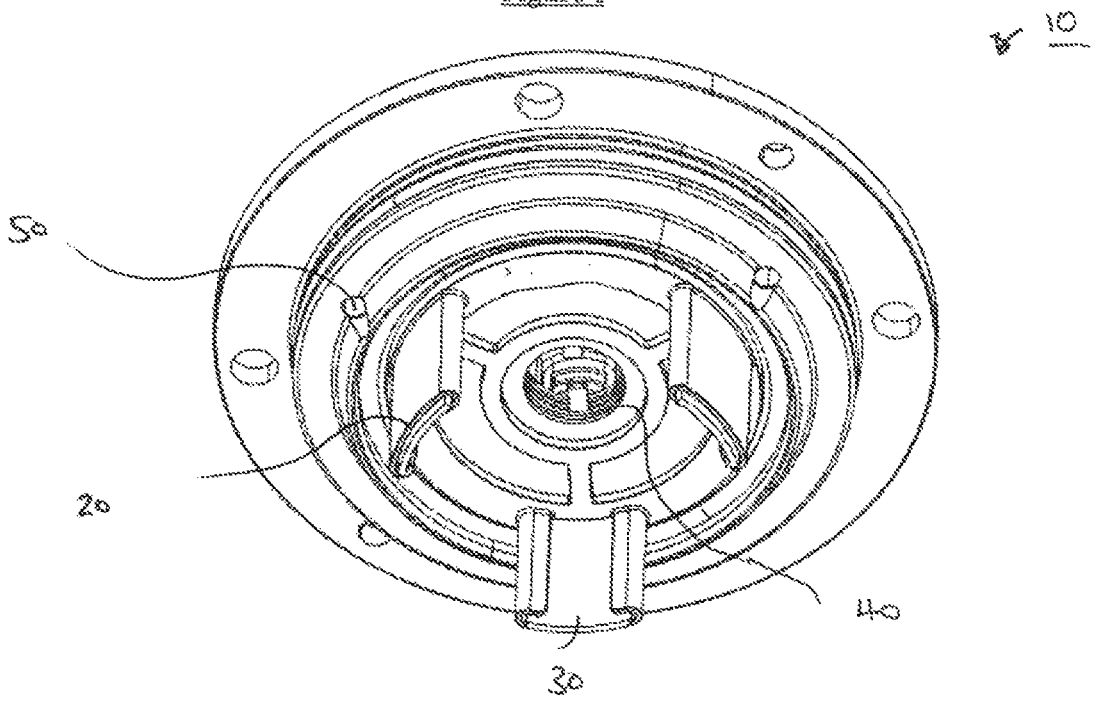
FIG. 2 shows another view of the oil feed cap of FIG. 1.

As can be seen in FIG. 2, the wick holders 20 retain a wick 30 which conveys oil from the reservoir within the vacuum pump to a bearing aperture 40 which receives the conical surface of the nut of the bearing, thereby feeding oil to the hearing. A number of coupling section conduits 50 are formed in the oil feed cap 10, which are in fluid communication with the vacuum pump.

Figure 3:
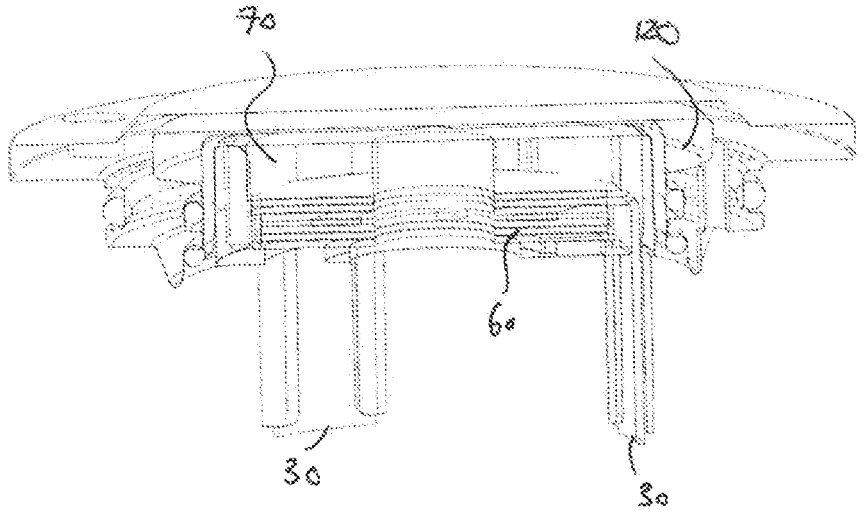
FIG. 3 is a cross-sectional view of the oil feed cap of FIG. 1.

As can be seen in FIG. 3, the wicks 30 are received by a stack of felts 60 which are stacked within a sump region 70 within the oil feed cap 10. A gallery section 120 extends around the sump region 70.

Bypass Conduit

Figure 4:
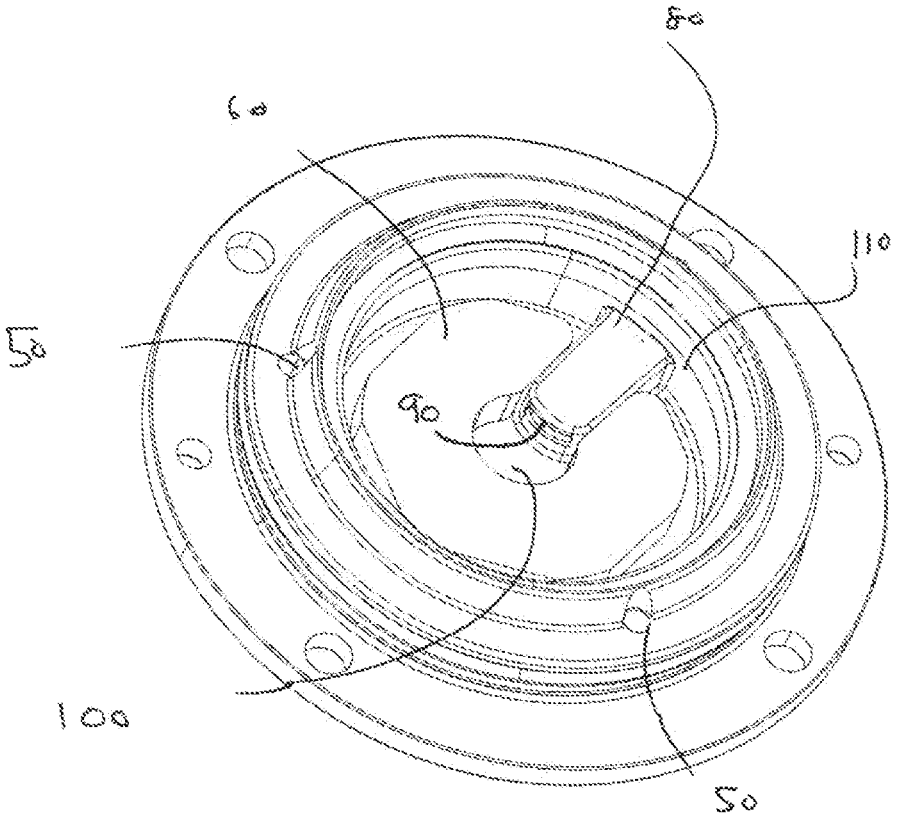
FIG. 4 is a view similar to FIG. 2 but with the wick holders removed.
Figure 6:
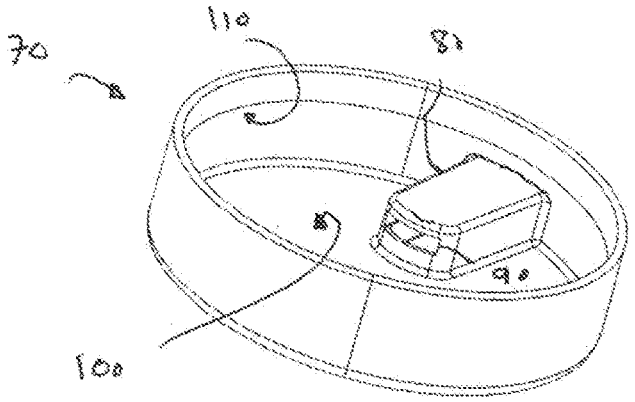
FIGS. 6 and 7 shows the sump section within the sump region.
Figure 7:
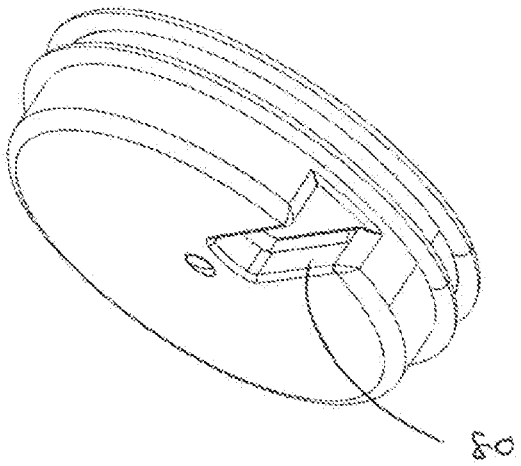

As can be seen in FIG. 4 (which has the wick holders 20 and associated structure removed to improve clarity), the sump region 70 contains a sump section 80 (which forms the first part of the bypass conduit) which extends radially inwards, towards the centre of the sump region 70 and which intersects the stack of felts 60. The sump section 80 defines an inlet 90. The inlet 90 is elevated above a first face 100 of the sump region 70 (defined by a circular plate), elevated above a second face (not shown—defined by an opposing circular plate supporting the wick holders 20) and elevated above a third face 110 (defined by a tubular wall extending between the first face 100 and the third face). Hence, as can be seen in FIGS. 6 and 7, should oil from the stack of felts 60 gather on the first face 100, the second face (not shown) or the third face 110, then the location of the inlet 90, which is raised off each of these faces, will impair or even prevent the flow of oil into the sump section 80. This helps to prevent loss of oil from the oil feed. The surface of the sump section 90 is rounded to help prevent the collection of oil. Also, the sump section 80 in the vicinity of the inlet 90 may be provided with drip edges to help prevent oil gathered on the sump section 80 from entering the inlet 90.

Figure 5:
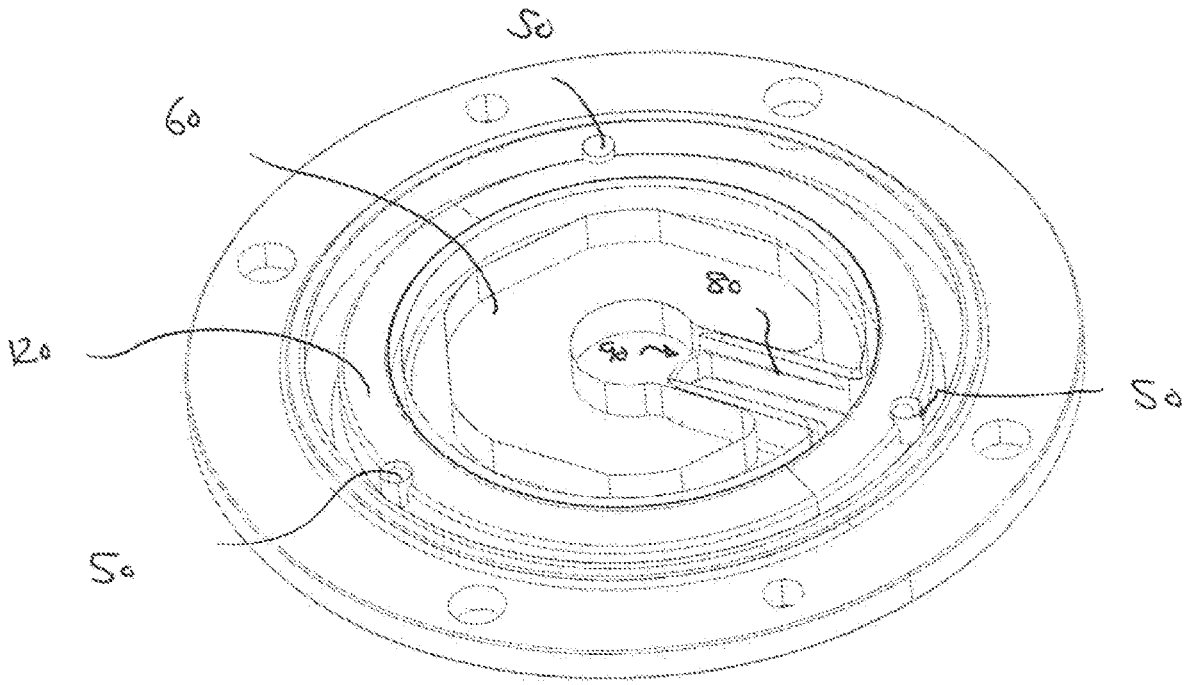
FIG. 5 is a cross-sectional view of the oil feed cap of FIG. 1.

As can be seen in FIG. 5, the bypass conduit defined by the sump section 80 fluidly couples with a gallery section 120 (which forms the second part of the bypass conduit) which comprises an annular chamber which concentrically surrounds the sump region 70. The coupling section conduits 50 (which forms the third part of the bypass conduit) are fluidly coupled with the gallery section 120. Although in this embodiment one of the coupling section conduits 50 is radially aligned with the sump section 80, in other embodiments the coupling section conduit 50 is not radially aligned with the sump section 80. That is to say that the coupling section conduit 50 may be circumferentially offset from the sump section 80.

In operation, when the vacuum pump is activated, gas within the sump region 70 is evacuated and flows primarily through the inlet 90, along the sump section 80, into the gallery section 120 and through the coupling section conduits 50 into the vacuum pump. As mentioned above, even when the gas flow out of the sump region 70 is high, the location of the inlet 90 helps to prevent the flow of oil together with the evacuating gas during pump-down.

The exact positioning of the inlet 90, and in particular the depth of the end portion of the sump section 80 which defines the inlet 90, is selected based on the expected depth of any excess oil which gathers in the sump region 70. Also, the dimensioning of the inlet 90 and the sump section 80 is set to control the velocity of the gas being pumped out of the sump region 70.

Oil Feed Cap—2nd Arrangement

Figure 8:
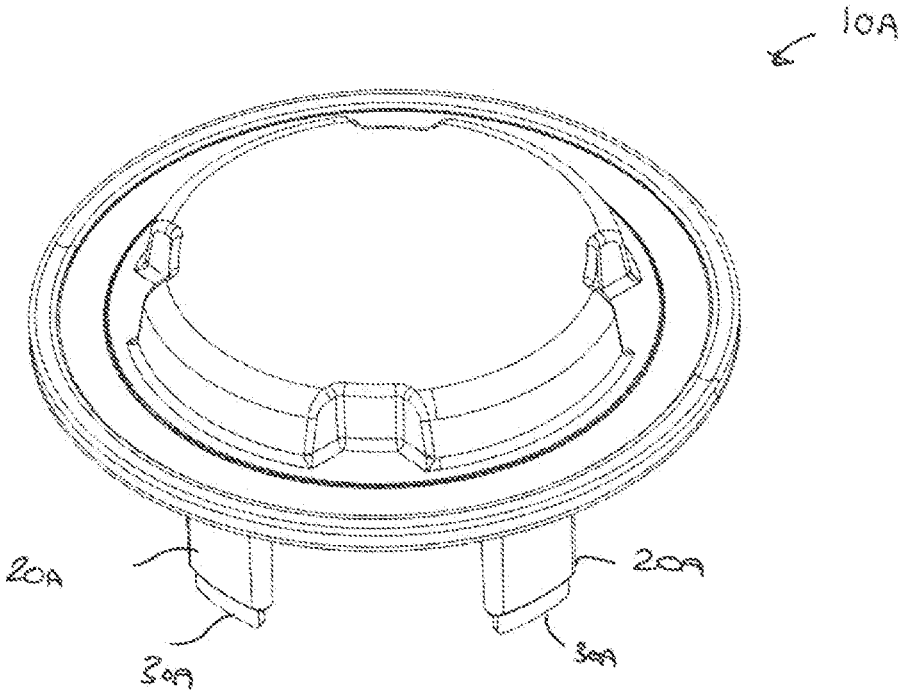
FIG. 8 shows an oil feed cap according to one embodiment.

FIG. 8 shows an oil feed cap 10A which feeds oil to a bearing of a vacuum pump (not shown). The oil feed cap 10A has a number of wick holders 20A which each receive a wick 30A.

Figure 9:
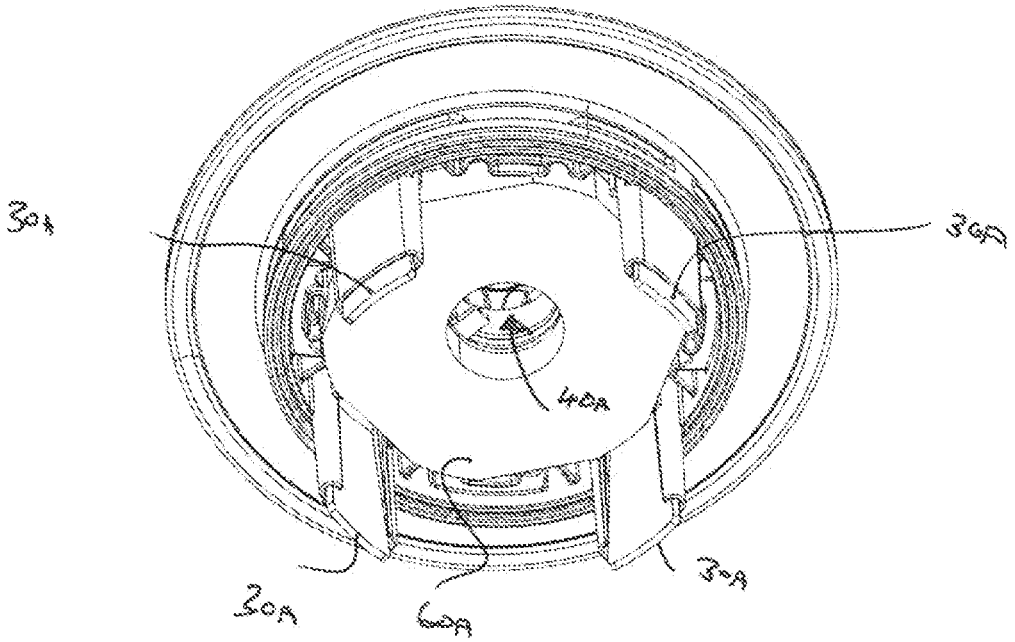
FIGS. 9 and 10 show other views of the oil feed cap of FIG. 8.
Figure 10:
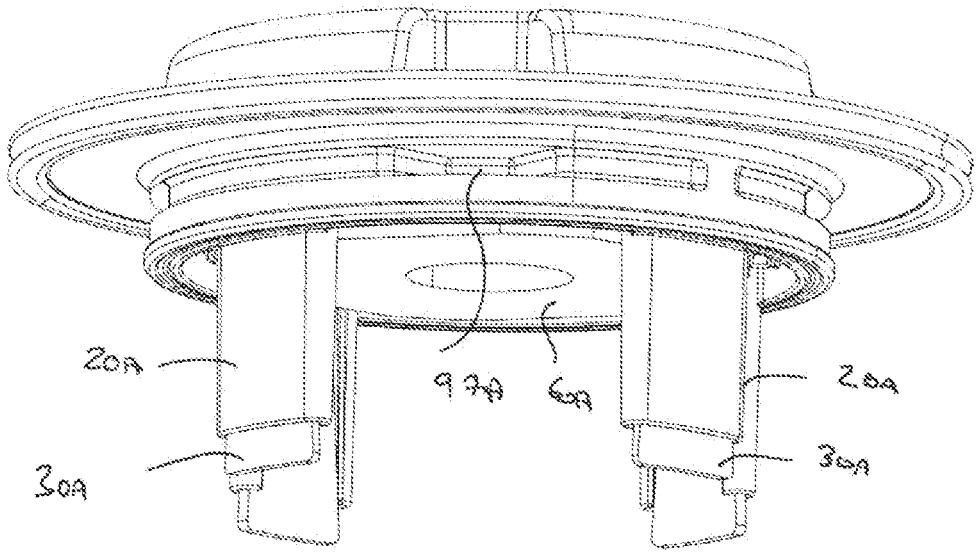

As can be seen in FIGS. 9 and 10, the wicks 30A feed a stack of felts 60A which provide oil to a bearing aperture 40A.

Bypass Conduit

Figure 11:
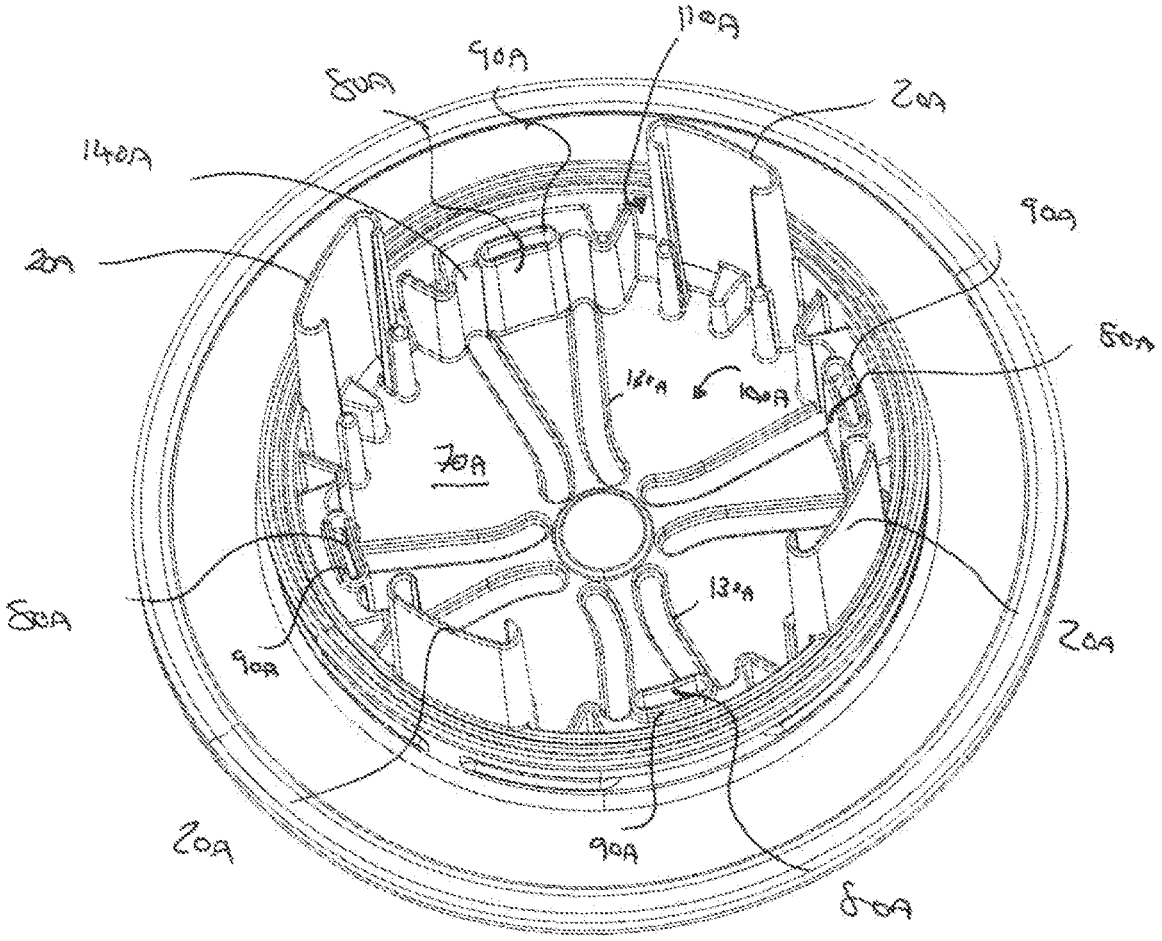
FIG. 11 is a view similar to FIG. 9 but with the wick holders removed.

As can be seen in FIG. 11 (in which the wicks 30A and the stack of felts 60A have been omitted to improve clarity), sump sections 80A (which form the first part of the bypass conduit) are provided, each of which have an inlet 90A. The inlet 90A is orientated in an axial direction with respect to a rotation axis of the bearing. The inlet 90A is located in an elevated position with respect to the first face 100A, the opposing second face (not shown) and the third face 110A.

Figure 12:
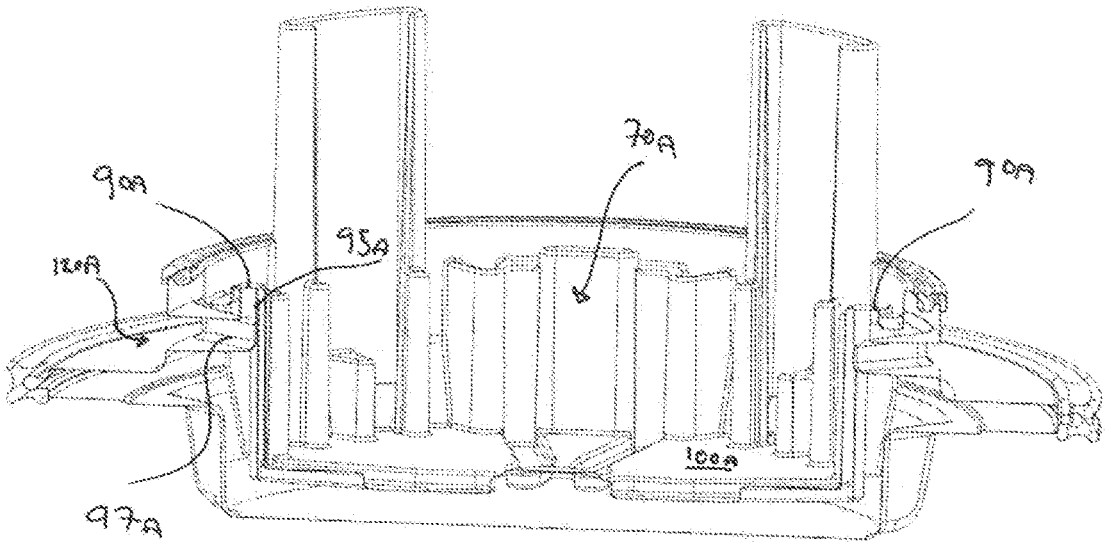
FIG. 12 is a cross-sectional view of FIG. 11.

As can be seen in FIG. 12, the sump section 80 forms an axially extending conduit section 95A which bends to form a radially extending conduit 97A. Each inlet 90A is in fluid communication with a gallery section 120A (which forms the second part of the bypass conduit) which is an annular chamber which concentrically surrounds the sump region 70A. The gallery section 120A is enclosed by a further structure (not shown) which provides the coupling section conduits (which form the third part of the bypass conduit) in a similar manner to that described above.

A series of recesses 130A are formed in the first face 100A. Recesses 140A extend axially along each side of the sump section 80A.

In operation, when pump-down occurs, gas is evacuated from the sump region 70A, assisted by flowing along the recesses 130A and 140A. The gas flows through the inlet 90A, along the axial section 95A and into the radial section 97A. The gas is then received within the gallery section 120A, flows through the coupling conduits and into the vacuum pump.

As mentioned above, even when the gas flow out of the sump region 70A is high, the location of the inlet 90A helps to prevent the flow of oil together with the evacuating gas during pump-down. It can be seen that due to the location of the inlets 90, irrespective of the orientation of the oil feed cap 10A, the inlets 90A are positioned above the likely level of any excess oil on any face within the sump region 70A, thereby helping to prevent loss of the oil during pump-down.

The exact positioning of the inlets 90A is selected based on the expected depth of any excess oil which gathers in the sump region 70A. Also, the dimensioning of the inlet 90A and the sump section 80A is set to control the velocity of the gas being pumped out of the sump region 70A.

Some embodiments provide a preferable gas path during pump down of a Turbo pump to prevent the oil in the oil sump reservoir or oil pot being drawn through the bearing and being lost into the pump. Some embodiments are functional in any orientation and not allow oil to drain out of the oil sump reservoir Unlike in some inverted-running pumping systems where it has been found during harsh pump down some of the oil is migrating through the bearing and being loss into the pump as this is the only exit for the gas from this area of the pump this starves the reservoir of volume of oil, some embodiments create a preferential gas path to remove the gas trapped in the oil cavity during harsh venting activities. This has been achieved by connection to the gas cavity with the backing line via a complex path to avoid loss of oil for the reservoir.

One embodiment involves slotting the lower oil felt and introducing a square tunnel section into the centre of the pot. A small gas inlet slot is created in the end of the tunnel to accept gas and the end is rounded so any oil that falls on the surface runs around and away from this inlet. The inlet is then connected via an annulus to the base cap and is vented to the wire cavity which in turn is connected to the hacking-line.

Another embodiment is an integrated moulded solution that involves intricate channelling. The gas firstly passes along the slots in the base of the oil pot and reaches the inner wall where is passes up the slotted inner wall and joins any gas drawn across the top face of the upper most felt. From this point it is drawn into the four slots, equispaced around the diameter, once drawn into these it is vented to the wire cavity via an external moulded slot formed on a sliding core. This embodiment also includes moulded sealing edges against vacuum loss.

Embodiments seek to avoid the loss of oil through either being drawn directly into the outlet or oil that has pooled running directly into the outlet when stored or run in a non-inverted orientation.

Embodiments save height in the pumping system by cutting the gas exhaust path into the current oil pot constraints i.e. the pump height stays the same.

Although illustrative embodiments of the invention have been disclosed in detail herein, with reference to the accompanying drawings, it is understood that the invention is not limited to the precise embodiment and that various changes and modifications can be effected therein by one skilled in the art without departing from the scope of the invention as defined by the appended claims and their equivalents.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. An oil feed assembly for a vacuum pump, comprising:

an oil feeder located for feeding oil to one side of a bearing of the vacuum pump;

an oil sump located on said one side of said bearing and configured to receive excess oil from said oil feeder and defined by a collection of faces; and a venting bypass conduit isolated from said oil sump except at an inlet, said inlet located at an elevated position above each face of said oil sump, and said venting bypass conduit configured to convey gas from said oil sump to another side of said bearing wherein regardless of an orientation of the vacuum pump, excess oil gathers on a respective face, of the collection of faces, outside of and below the inlet.

2. The oil feed assembly of claim 1, wherein said elevated position is higher than an expected depth of said excess oil.

3. The oil feed assembly of claim 1, wherein said venting bypass conduit has a sump section defining said inlet, said sump section extending from at least one face, of the collection of faces, of said oil sump.

4. The oil feed assembly of claim 3, wherein said sump section extends in at least one of an axial direction and a radial direction with respect to said bearing.

5. The oil feed assembly of claim 3, wherein said sump section is rounded to resist gathering of oil.

6. The oil feed assembly of claim 3, wherein said venting bypass conduit comprises a gallery section fluidly coupled with said sump section, extending around said oil sump.

7. The oil feed assembly of claim 6, wherein said gallery section comprises an annulus extending circumferentially, concentric with said bearing.

8. The oil feed assembly of claim 6, wherein said sump section comprises a plurality of sump sections and wherein said inlet comprises a plurality of inlets, each sump section of said plurality of sump sections defining one inlet of said plurality of inlets, each of said plurality of sump sections being fluidly coupled with said gallery section.

9. The oil feed assembly of claim 6, wherein said venting bypass conduit comprises a coupling section fluidly coupled with said gallery section.

10. The oil feed assembly of claim 9, wherein said coupling section fluidly couples with said other side of said bearing.

11. The oil feed assembly of claim 6, wherein said sump section and one part of said gallery section are formed as a first unitary part, and said coupling section and another part of said gallery section are formed as a second unitary part.

12. The oil feed assembly of claim 1, wherein said oil sump defines at least one recess to facilitate flow of gas past said oil feeder.

* * * * *